US010122110B2

(12) United States Patent
Binzel

(10) Patent No.: US 10,122,110 B2
(45) Date of Patent: Nov. 6, 2018

(54) COUPLING FOR POWER CABLES

(71) Applicant: TBI Industries GmbH, Fernwald (DE)

(72) Inventor: Oliver Binzel, Muttenz (CH)

(73) Assignee: TBI Industries, GMBH, Fernwald (DE)

( * ) Notice: Subject to any disclaimer, the term of this patent is extended or adjusted under 35 U.S.C. 154(b) by 0 days.

(21) Appl. No.: 15/673,131

(22) Filed: Aug. 9, 2017

(65) Prior Publication Data

US 2018/0026386 A1 Jan. 25, 2018

Related U.S. Application Data

(63) Continuation of application No. PCT/EP2016/053051, filed on Feb. 12, 2016.

(30) Foreign Application Priority Data

Feb. 13, 2015 (DE) ..... 10 2015 001 717

(51) Int. Cl.
*H01R 13/62* (2006.01)
*H01R 13/213* (2006.01)
*H01R 4/30* (2006.01)
*H01R 13/625* (2006.01)

(52) U.S. Cl.
CPC ..... *H01R 13/213* (2013.01); *H01R 4/302* (2013.01); *H01R 13/625* (2013.01)

(58) Field of Classification Search
CPC ..... H01R 13/213; H01R 13/625
USPC ..... 439/311, 314–318
See application file for complete search history.

(56) References Cited

U.S. PATENT DOCUMENTS 3,982,808 A * 9/1976 Marechal ..... H01R 4/54 439/314
5,015,195 A * 5/1991 Piriz ..... H01R 13/17 439/272
8,197,155 B2 * 6/2012 Noh ..... B60T 11/046 188/2 D
9,859,652 B2 * 1/2018 Gunther ..... H01R 13/631

FOREIGN PATENT DOCUMENTS

WO 03065784 A2 8/2003

OTHER PUBLICATIONS

International Preliminary Report on Patentability for corresponding PCT Application No. PCT/EP2016/053051, mailed on Aug. 15, 2017.
International Search Report in corresponding PCT Application No. PCT/EP2016/053051, dated May 18, 2016, with English translation.

* cited by examiner

*Primary Examiner* — Xuong Chung Trans
(74) *Attorney, Agent, or Firm* — Edell, Shapiro & Finnan, LLC

(57) ABSTRACT

The invention relates to a coupling for power cables, consisting of a plug part and a socket part, said plug part having a basic body comprising a coupling pin on which a locking pin is arranged. The locking pin is movably mounted on the coupling pin so as to be displaceable in the axial direction of the coupling pin. The locking pin is biased to a basic position towards a back end of the coupling pin by a spring force. When the coupling is being locked, the locking pin engages a helical groove of the socket part and, thus, moves towards the front end of the coupling pin. This movement causes the spring device to load.

20 Claims, 2 Drawing Sheets

Fig. 1
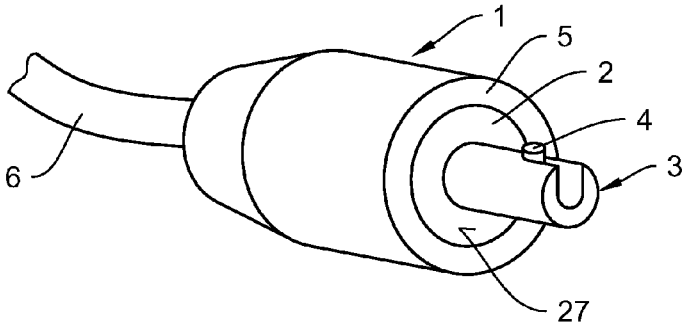
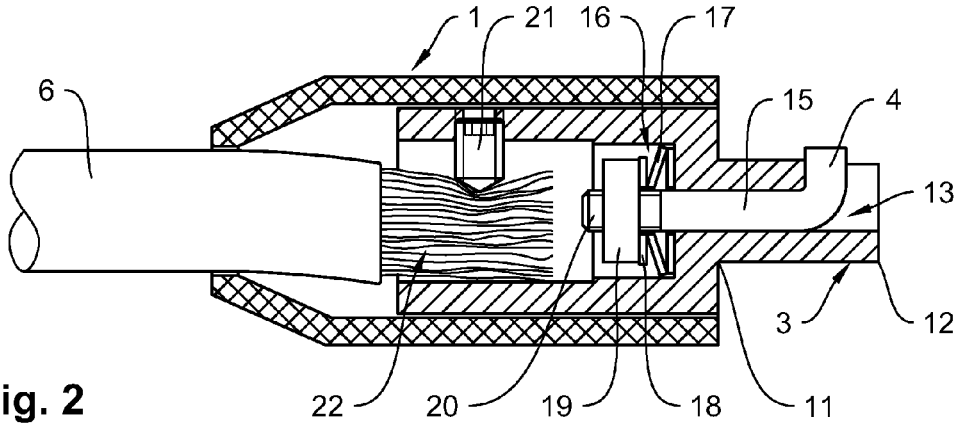
Fig. 2
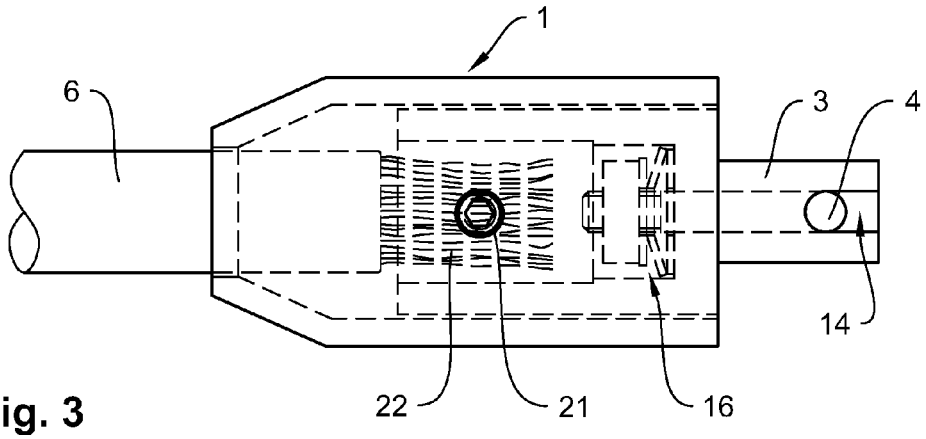
Fig. 3

COUPLING FOR POWER CABLES

CROSS REFERENCE TO RELATED APPLICATIONS

This application is a continuation of International Application No. PCT/EP2016/053051, filed on Feb. 12, 2016, which claims priority under 35 U.S.C. § 119 to Application No. DE102015001717.9 filed on Feb. 13, 2015, the entire contents of both of which are hereby incorporated by reference.

TECHNICAL FIELD

The invention relates to a coupling for power cables

BACKGROUND

Couplings for power cables typically comprise coupling elements which are locked by means of a bayonet connector. Since both coupling elements, i.e. the plug part and the socket part, are solidly made according to the state of the art, a rigid connection is attained which remains in the locked position only due to the friction forces.

In order to maintain a largest possible friction force, a normal force is produced via a bayonet mechanism, said normal force pressing the plug and the socket together. Moreover, a strong normal force is important for maintaining a low-impedance electric transition between the plug part and the socket part.

Consequently, couplings having a plug part, a bayonet mechanism, and a socket part are generally used in welding installations. In fact, the DIN EN 60974-12 standard "Coupling devices for welding cables" exists as a standard for conventional connectors used in welding technology, and many components found in the market are configured in accordance with this standard. The components differ from producer to producer due to numerous remaining liberties in design and construction when it comes to the standard's application. Consequently, an ideal compatibility is not readily ensured.

A problem which commonly occurs in practice is that the plug connections known thus far can detach of their own accord after a period of time. This may be because of purely constructive principles, as both the plug part and the socket part are comparatively rigid components. After locking the plug connection, only a very slight elastic deformation of the parts is possible so that the contact surfaces are immediately lifted upon the slightest back rotation of the connectors and the normal force between the components drops to zero. In this condition, the electric contact resistance of the contact increases dramatically.

In practice, the described detachment process often arises due to mechanical vibrations, an increase in the temperature of the plug connectors during operation and heat expansions connected thereto and/or contact surfaces behaviors. Consequently, an even larger and irregular increase in the temperature of the components occurs via the increased contact resistance, which can amplify the effect.

The increase in temperature can further lead to damage to the connectors, their insulation, the connected cables, and/or machine parts.

In welding installations, increased contact resistance in a connection, which often fluctuates in dependence of vibrations, often causes a temporally variable drop in voltage in the power-cable connection and thus in the electric circuit when there is a loose connection. Through this, the electric arc voltage is involuntarily influenced; the quality of the welding process can drop or become instable.

SUMMARY

The object of the present invention is to reliably prevent the plug connection of the coupling from detaching of its own accord and to produce a lowest possible, constant contact resistance. The plug parts and the socket parts should be compatible with the commonly known elements so that components made by different producers can be combined without any difficulties.

In the coupling according to the invention, the locking pin is displaceably mounted in the plug part in the axial direction of the coupling pin, said locking pin being held in a basic position towards a back end of the coupling pin by means of a spring device. The locking pin is moved, in the socket part, towards the front end of the coupling pin via a form fit when the engagement connection is produced between the plug part and the socket part. The spring device is loaded so as to form a pre-load force.

By implementing the solution according to the invention, it is attained that an elastic element is inserted into the system so that a sufficiently high normal force can be maintained between the plug part and the socket part in a large displacement area of the bayonet connector. For this purpose, the current transition areas formed in particular by the front sides of the plug part and the socket part are not changed so that they are formed directly on solid components as in the state of the art. The elasticity is implemented via a resiliently mounted locking pin which is realized such that it can be inserted into the guiding groove of the bayonet connector when in the unloaded position and is loaded against spring force while being locked by rotating the plug part and the socket part against each other. A significant decrease in the contact force between the two coupling halves due to small changes in the system, such as a slight loosening, thermal expansion or setting occurrences between the contact surfaces, is reliably prevented by the invention.

In comparison to known solutions, the coupling according to the invention is more secure against a self-actuated detachment and is compatible with generic components on the market.

The invention is an advancement of known coupling elements for high-voltage connections, the transferred voltages generally being between approximately 20 and 600 A. The elements are preferably realized unipolar and serve for low-impedance connections of flexible copper cables having cross sections of approximately 10 to 120 mm2. The plug part or the socket part can also be realized as bulkheads for installation in machines or switch cabinets.

In the simplest embodiment, only the plug part can be realized changed in comparison to now commonplace components.

An essential advantage of the coupling according to the invention is that disruptive influences on a welding process due to loosening connections can be eliminated. The improved plug connection between the plug part and the socket part can easily be retrofitted into existing systems and also be combined with other components.

In a preferred embodiment, the coupling pin of the plug part is provided with a central through bore as well as a radial recess, in particular one produced by milling. A tension rod is guided in the central through bore and includes the radially arranged locking pin at its front end. The locking pin passes through the radial recess and the spring device is arranged between the basic body and the tension rod in such a manner that when the engagement connection is produced between the plug part and the socket part, the locking pin is displaced into the socket part and the pre-load force becomes larger.

Alternatively, the coupling pin with a radially arranged locking pin can be mounted in the basic body of the plug part in an axially displaceable manner and the spring device can be arranged between the basic body and the coupling pin in such a manner that when the engagement connection is produced between the plug part and the socket part, the coupling pin is pulled out of the basic body and the spring force becomes larger.

Preferably, the spring device comprises at least one plate spring.

At the front end of the coupling pin, a stop can be formed for limiting the movement of the locking pin.

Preferably, the stop for the movement of the locking pin is defined by the end of the spring path of the at least one plate spring.

If the groove formed in the socket part comprises a groove segment arranged parallel to the front side at the end of the groove facing away from the front side in such a manner that when the engagement connection is produced between the plug part and the socket part, a continuous increase of the pre-load of the spring device remains constant at first while the locking pin is being displaced in the area of the helical segment of the groove. Subsequently, the pre-load remains constant while the locking pin is being displaced in the area of the groove segment. With at least this embodiment, a noticeable locking connection can be realized, t which provides additional protection against an unintended detachment.

In another embodiment, the groove formed in the socket part can comprise a groove segment facing back to the front side at the end of the groove facing away from the front side in such a manner that when the engagement connection is produced between the plug part and the socket part, a continuous increase of the pre-load of the spring device is continuously reduced at first while the locking pin is being displaced in the area of the helical segment Subsequently, the pre-load is continuously reduced while the locking pin is being displaced in the area of the groove segment.

It is particularly advantageous if either the plug part or the socket part is intended to be installed in an electrical device.

BRIEF DESCRIPTION OF THE DRAWINGS

In the following, advantageous embodiments of the invention are further described by way of the drawing.

In the drawings:

FIG. 1 shows a plug part of a coupling in an isometric view;

FIG. 2 shows a sectional, longitudinal view of the plug part shown in FIG. 1;

FIG. 3 shows a top, sectional view of the plug part shown in FIG. 1;

DETAILED DESCRIPTION

Figure 4:
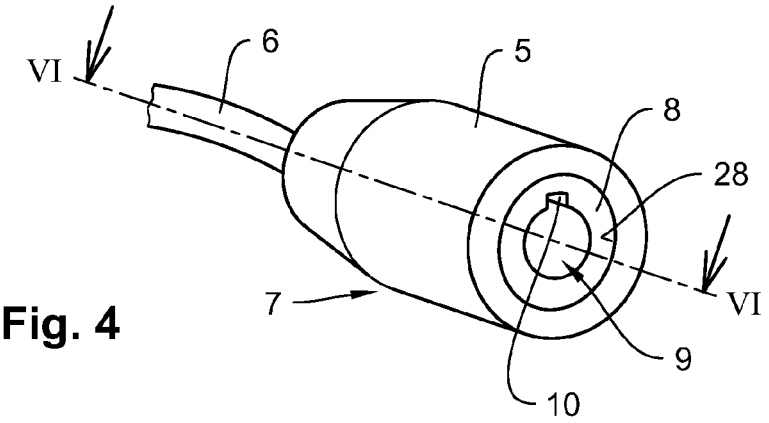
FIG. 4 shows a socket part of a coupling in an isometric view.

In a synopsis of FIGS. 1 to 3, a plug part 1 of a coupling 5 is shown which comprises a coupling pin 3 which starts from a front side 27 of a basic body 2 and has a longitudinal bore 13. That is, the coupling pin 3 extends from a back end 11 (which is disposed at the front side 27 of the basic body 2) to a front end 12 (which is spaced from the front side 27 of the basic body 2) and a bore 13 extends substantially between the front end 12 and the back end 11. In addition to the longitudinal bore 13, the coupling pin 3 also comprises a recess 14 preferably produced by milling for accommodating a locking pin 4. The locking pin 4 is formed by an elbowed end of a tension rod 15 accommodated in the longitudinal bore 13, said locking pin 4 formed by the elbowed end passing through the recess 14 and radially protruding from the coupling pin 3. This elbowed and protruding end of the tension rod 15 forms the locking pin 4 which can be displaced in the longitudinal direction of the plug part 1 while the other end of the tension rod 15 is locked within the basic body 2 of the plug part 1. In the depicted embodiment, the other end of the tension rod 15 is locked within the basic body 2 by means of a spring device 16 which comprises a plate spring 17. The plate spring 17 is arranged between a bore offset of the longitudinal bore 13 formed in a basic body 2 and a nut 19 arranged on a thread offset 20 of the tension rod 15.

Using one or more plate springs as a spring element of the spring device 16 proves to be particularly advantageous since plate springs are able to develop large spring forces in small ranges and installation spaces. It is also particularly advantageous if the maximum spring path of the locking pin 4 can be limited without any other components other than the spring device 16 and basic body 2. For example, in the depicted embodiment, the spring path is limited by pressing the spring plate flat so that the spring plate forms a mechanically stiff stop (the stop being formed when part 18 is flush against the plate spring 17 in the depicted embodiment). By tightening the coupling in accordance with the techniques described herein, high contact forces can be attained between the two coupling halves as in rigid couplings according to the state of the art which comprise an immovable locking pin.

In FIGS. 4 to 8, a socket part 7 of coupling 5 is shown which comprises an accommodating bore 9 formed in a basic body 8 for accommodating the coupling pin 3 of the plug part 1. In a bore wall 29 of the basic body 8, a groove 10 is formed which comprises different groove segments, namely a groove beginning segment 23, a helical segment 24 and a ending groove segment 25/26. By combining groove segments with different inclinations, the coupling 5 can be better secured against becoming unintendedly loosened. The groove beginning segment 23 extends to the accommodating bore 9 arranged parallel to the axis starting from a front side 28 of the basic body 8. The groove beginning segment 23 serves to easily insert the coupling pin 3 of the plug part 1 into the socket part 7. The helical segment 24 follows immediately thereafter, said helical segment 24 comprising a constant positive inclination.

In order to produce a coupling connection between the plug part 1 and the socket part 7, the locking pin 4 is inserted into the groove beginning segment 23. When subsequently rotating the plug part 1 against the socket part 7, the locking pin 4 of the plug part 1 follows the helical segment 24 of the groove 10, whereby the coupling parts are pulled together like in a bayonet connector, a surface contact is formed between the front sides 27, 28 and the spring device 16 is loaded. That is, the spring device 16 is moved away from its rest position so that the spring device 16 is generating a biasing force acting against the longitudinal movement of the locking pin 4.

Figure 7:
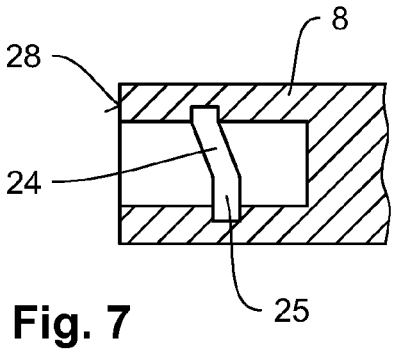
FIG. 7 shows a sectional view of the basic body shown in FIG. 6 taken along line VII-VII in FIG. 6 in accordance with a first embodiment of a groove formed in the basic body.

In the embodiment of the groove 10 shown in FIG. 7, ending groove segment 25 connects with zero inclination, i.e. the groove segment 25 extends parallel to the front side 28 of the basic body. Once the locking pin 4 reaches the groove segment 25, the spring device 16 is not loaded any further. However, the force component directed towards an opening rotating direction of the coupling (which is produced in the helical segment 24, due to its positive inclination) is no longer produced. Only the friction forces between the coupling parts, i.e. the plug part 1 and the socket part 7, act against this force component so that the coupling can be opened more easily, i.e. with less expenditure of force, than it can be closed. That is, due to the arrangement of the groove segment 25, internal forces in the coupling are no longer exerted when opening the connection and the external force for opening the connection is increased since the supporting force is dispensed via the inclined plane between the locking pin 4 and the helical segment 24.

Figure 5:
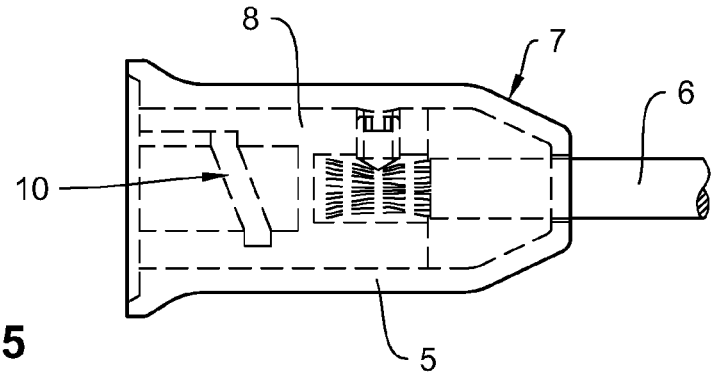
FIG. 5 shows a side, sectional view of the socket part shown in FIG. 4.
Figure 6:
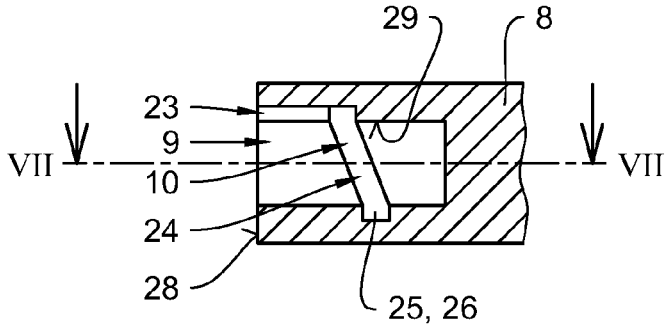
FIG. 6 shows a partial sectional view of a basic body of the socket part shown in FIG. 4 taken along line VI-VI in FIG. 4.

When guiding the locking pin 4 into the helical segment 24 of the groove 10, i.e. when locking the bayonet connector, subsequent to the plug part 1 shown in FIG. 2 being inserted into the socket part 7 shown in FIG. 5, the tension rod 15 is pulled out of the plug part 1 against the pre-load force of the spring device 16, whereby the contact force is precisely defined. When loosening the plug part 1, the contact force between the front sides 27, 28 forming the contact surfaces continuously drops according to the characteristic curve of the spring. Consequently, a sudden releases and immediate loosening of the connection, as is common in the state of the art are reliably prevented. Thermal expansion and setting behaviors of the connection are elastically compensated without it having to come to a relevant change in the pre-load force. Thus, the ohmic contact resistance of the connection practically remains constant.

This new situation, which represents a significant technological advancement, only becomes possible via the socket part according to the invention. Additionally, the socket part according to the invention can be realized in such a manner that it remains compatible with already existing plug parts realized in a rigid manner having an immovable locking pin according to the state of the art. This is attained by realizing the helical segment so that a rigidly installed locking pin, which is geometrically realized according to the standard IEC 60974-12, cannot reach the subsequent groove segment.

Figure 8:
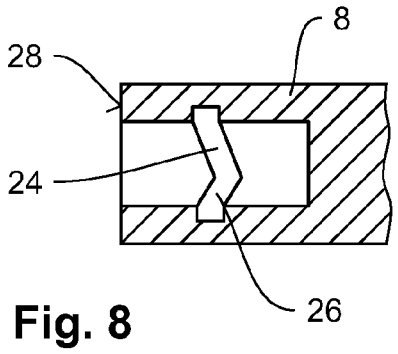
FIG. 8 shows a second embodiment of the groove shown in FIG. 7.

In the embodiment of the groove 10 shown in FIG. 8, the groove segment 26 comprises a negative inclination so that the groove segment 26 is faced back towards the front side 28. In this instance, the user of the coupling will notice a significant change in the tightening torque when the spring-loaded locking pin 4 is transferred from the helical segment 24 having a positive inclination into the groove segment 26 having a negative inclination. That is, the tightening torque will suddenly decrease when the helical segment 24 transfers to the groove segment 26 which will intuitively be understood as the coupling locking. The user will therefore know that the coupling is correctly locked. For detaching the coupling, an increasing torque must first be mustered in order to overcome the transition point between the helical segment 24 and the groove segment 26 of the groove 10. An accidental loosening is therefore not possible.

Now referring back to FIGS. 1-3, at an end of the plug part 1 opposite the coupling pin 3, the plug part 1 is configured to receive a power cable 6. In particular, the plug part 1 includes an opening sized to receive a cable and an engagement member 21 configured to secure conductor elements 22 of the power cable 6 within the plug part 1. The connector element 21 may form an electrical connection between the basic body 2 of the plug part 1 (the basic body 2 may be encapsulated within an insulated sleeve). Although not labeled in FIGS. 4-7, the socket 7 also includes similar elements. Consequently, when the plug part 1 is secured against the socket part 7, an electrical connection is formed between any cables 6 secured therein. That is, securing the plug part 1 to the socket part 7 may form a secure connection between a first power cable 6 (or a first portion of power cable 6) secured in the plug part 1 and a second power cable 6 (or a second portion of a power cable 6) secured in the socket part 7.

What is claimed is:

1. A coupling for connecting a power cable in a fixed manner, comprising:

a plug part including:

a basic body;

a coupling pin projecting over a front side of the basic body and arranged in the axial direction of the coupling;

a locking pin that is movably mounted on the coupling pin, the locking pin being movable along the coupling pin in an axial direction;

a spring device that biases the locking pin towards a back end of the coupling pin; and a first power cable that is electrically connected to the basic body of the plug part; and a socket part including:

a basic body;

an axial bore that extends through the basic body of the socket part and is sized to accommodate the coupling pin;

a groove formed in a wall of the axial bore, the groove starting from a front side of the basic body of the socket part and comprising a helical segment, said groove serving to accommodate the locking pin of the plug part; and a second power cable that is electrically connected to the basic body of the socket part, wherein, when the coupling pin is inserted into the bore of the socket part, the locking pin is accommodated in the groove of the socket part and displaced towards a free end of the coupling pin and the spring device exerts a pre-load force on the locking pin, so that the plug part and the socket part are clamped against each other in an engagement connection and an electrical connection is formed between the first power cable and the second power cable.

2. The coupling of claim 1, wherein the coupling pin of the plug part comprises:

a central through bore;

a radial recess;

a tension rod that extends through the central through bore, wherein the locking pin is radially arranged on a front end of the tension rod and passes through the radial recess and the spring device is arranged between the basic body of the plug part and the tension rod in such a manner that when the engagement connection is produced between the plug part and the socket part, the locking pin is displaced into the socket part and the pre-load force increases.

3. The coupling of claim 1, characterized in that the spring device comprises at least one plate spring.

4. The coupling of claim 1, characterized in that a stop for limiting the movement of the locking pin is formed at a front end of the coupling pin.

5. The coupling of claim 4, characterized in that the stop for limiting the movement of the locking pin is defined by an end of a spring path of the spring device.

6. The coupling of claim 1, characterized in that the coupling pin is axially displaceable in the basic body of the socket part, and the spring device is arranged between the basic body of the plug part and the coupling pin in such a manner that when the engagement connection is produced between the plug part and the socket part, the coupling pin is pulled out of the basic body and the pre-load force increases.

7. The coupling of claim 1, characterized in that the groove formed in the socket part comprises:

a groove segment arranged parallel to the front side of the basic body of the socket part at a terminal end of the groove, such that when the engagement connection is produced between the plug part and the socket part, a continuous increase of the pre-load of the spring device remains constant while the locking pin is being displaced in the helical segment of the groove and the pre-load force remains constant while the locking pin is being displaced the groove segment.

8. The coupling of claim 1, characterized in that the groove formed in the socket part comprises:

a groove segment facing back to the front side of the basic body of the socket part at a terminal end of the groove, such that when the engagement connection is produced between the plug part and the socket part, a continuous increase of the pre-load force of the spring device is continuously reduced while the locking pin is being displaced in the helical segment of the groove and the pre-load force is continuously reduced while the locking pin is being displaced in the groove segment.

9. The coupling of claim 1, characterized in that either the plug part or the socket part is installed in an electrical device.

10. A coupling for power cables comprising:

a plug part that defines an end of a first power cable, the plug part comprising:

a plug body with a front contact surface and a longitudinal axis that extends perpendicular to the front contact surface; and a locking pin that extends radially from the longitudinal axis and that is displaceable so that the locking pin is disposable at different distances beyond the front contact surface of the plug body; and a spring device configured to bias the locking pin towards the plug body; and a socket part that defines an end of a second power cable, the socket part comprising:

a socket body with a front contact surface and a bore that allows the locking pin to move into the socket body; and a groove that is sized to receive the locking pin, the groove including an initial segment and a helical segment, the initial segment extending from the front contact surface of the main body of the socket part to the helical segment, wherein moving the locking pin along the groove of the socket part produces an engagement connection between the plug part and the socket part where the front contact surface of the plug part is secured in contact with the front contact surface of the socket part and the first power cable is electrically connected to the first power cable.

11. The coupling for power cables of claim 10, wherein the spring device exerts a force on the locking pin in the direction of the plug body as the locking pin moves along the groove and the force increases as the locking pin moves further along the groove.

12. The coupling for power cables of claim 10, wherein the helical segment has a constant positive inclination away from the front contact surface of the main body of the socket part.

13. The coupling for power cables of claim 10, wherein the helical segment extends from the initial segment to an ending groove segment that extends parallel to or towards the front contact surface of the main body of the socket part.

14. The coupling for power cables of claim 10, wherein the plug part further comprises:

a coupling pin that projects beyond the front contact surface of the plug body along the longitudinal axis, wherein the locking pin extends radially from the coupling pin.

15. The coupling for power cables of claim 14, wherein the coupling pin includes a longitudinal bore and a pin portion, the pin portion being moveably accommodated in the longitudinal bore.

16. The coupling for power cables of claim 14, wherein the coupling pin is a cylindrical projection that is coaxial with the plug body.

17. The coupling for power cables of claim 10, wherein the spring device comprises one or more plate springs.

18. A plug part for a power coupling, comprising:

a basic body with a front contact surface and a longitudinal axis that extends perpendicular to the front contact surface; and a power cable that is electrically connected to the basic body of the plug part;

a coupling pin that projects beyond the front contact surface of the basic body along the longitudinal axis;

a locking pin that extend radially from the coupling pin and that is displaceable with respect to the coupling pin so that the locking pin is disposable at different distances beyond the front contact surface of the basic body; and a spring device configured to bias the locking pin towards the basic body, wherein upon insertion into a socket part, the locking pin is displaced away from the basic body and the spring device secures the front contact surface of the plug part to the socket part while the power cable is electrically connected to a power cable included in the socket part.

19. The plug part of claim 18, wherein the coupling pin further comprises a central through bore and a radial recess and the plug part further comprises:

a tension rod that extends through the central through bore, wherein the locking pin is radially arranged on a front end of the tension rod and passes through the radial recess, and wherein the spring device is arranged between the basic body of the plug part and the tension rod.

20. The plug part of claim 18, wherein the spring device comprises at least one plate spring.

* * * * *